United States Patent [19]

Parish

[11] Patent Number: 4,959,901

[45] Date of Patent: Oct. 2, 1990

[54] PORTABLE INFLATABLE SHELTER AND METHOD OF ERECTION THEREOF

[75] Inventor: James M. Parish, Wadsworth, Ohio

[73] Assignee: SMR Technologies, Inc., Uniontown, Ohio

[21] Appl. No.: 370,199

[22] Filed: Jun. 22, 1989

[51] Int. Cl.[5] ..... E04H 15/20

[52] U.S. Cl. ..... 52/2 K; 135/900; 135/905; 135/106

[58] Field of Search ..... 135/900, 905, 90, 101, 135/106; 52/2 K, 2 R, 2 G, 2 P

[56] References Cited

U.S. PATENT DOCUMENTS

| | | | |
|---|---|---|---|
| 1,640,188 | 8/1927 | Grunbock | 135/90 |
| 1,803,237 | 4/1931 | Crooke | 135/90 |
| 1,964,818 | 7/1934 | Hood | 52/2 K |
| 2,528,721 | 11/1950 | Brockman et al. | 135/900 |
| 2,955,606 | 10/1960 | Walker | 52/2 K |
| 3,183,916 | 5/1965 | Marino | 135/90 |
| 3,452,764 | 7/1969 | Bell | 135/900 |
| 4,205,695 | 6/1980 | Stoddard | 135/90 |
| 4,251,959 | 2/1981 | Hsu | 52/2 K |
| 4,631,873 | 12/1986 | Parish | 52/2 |
| 4,834,129 | 5/1989 | Pinsonneault | 135/90 |

*Primary Examiner*—David A. Scherbel

*Assistant Examiner*—Caroline D. Dennison

*Attorney, Agent, or Firm*—Renner, Kenner, Greive, Bobak, Taylor & Weber

[57] ABSTRACT

A portable inflatable shelter (10) for temporarily covering a portion of an object, such as an aircraft engine (12), while partially resting on another portion of the object, such as an aircraft wing (13), includes a plurality of inflatable interconnected tubes (15–25) which carry fabric (26) extending therebetween. When the tubes (15–25) are inflated, the shelter formed thereby includes a roof section over the portion of the object, side sections on each side of the portion of the object, a front access opening, and an overhang section resting on the other portion of the object. The shelter (10) is erected by positioning the uninflated shelter adjacent to the portion of the object to be covered with the front access opening facing the ground. Guy lines (31,33) are then attached from one of the side sections of the shelter to a first point (32) on the ground. Additional guy lines (34,36) are attached from the other side section to a second point (35) on the ground. The shelter (10) is then inflated and pivoted on an axis (30) defined by the first (32) and second (35) points so that the shelfter (10) encloses the portion of the object to be covered.

23 Claims, 4 Drawing Sheets

PORTABLE INFLATABLE SHELTER AND METHOD OF ERECTION THEREOF

TECHNICAL FIELD

This invention relates to a portable inflatable shelter such as can be utilized to temporarily cover selected portions of aircraft or the like so that maintenance can be performed thereon outdoors and yet out of the elements. In addition, this invention relates to the manner in which such a shelter can be quickly and easily erected so that even emergency maintenance can be performed without regard to the existing weather conditions.

BACKGROUND ART

Inflatable structures are known in the art. One type of inflatable structure is totally air supported, much like a balloon, and can only be permanently erected at a desired location —— portability not being feasible in such structures.

Another type of inflatable structure which is intended to be portable is of the type where inflated tubes or beams support the fabric for the structure such as disclosed in U.S. Pat. No. 4,631,873. Such structures are totally self-supporting and while useful for many purposes, they are not practical for certain applications. For example, such structures are not suitable for enclosing a portion of a large piece of equipment, such as the engine of an aircraft. Moreover, structures according to that patent have to be inflated before they are tied down and secured. As such, and particularly in windy weather conditions, the erection and stabilization of such structures can be difficult and require a great deal of manpower. Such weather conditions are often encountered on airfields where, in the absence of an available hangar, maintenance of certain portions of aircraft may have to be performed. To date, there is no known portable shelter which can be quickly and easily erected over a portion of an aircraft or other large equipment so that maintenance thereof or other work thereon can take place sheltered from the elements.

DISCLOSURE OF THE INVENTION

It is thus a primary object of the present invention to provide a portable inflatable shelter which can be used to temporarily cover portions of larger objects such as aircraft and the like.

It is another object of the present invention to provide a portable inflatable shelter, as above, which is not free standing but rather has a portion thereof resting on the object it is temporarily covering without damage to the object.

It is a further object of the present invention to provide a portable inflatable shelter, as above, which is secured to the object it is temporarily covering.

It is another primary object of the present invention to provide a method of erection of the portable inflatable shelter which can be accomplished easily and quickly with little manpower even in adverse weather conditions.

It is an additional object of the present invention to provide a method of erection of the portable inflatable shelter, as above, in which the shelter is anchored before inflation and easily rotated into operating position thereafter.

These and other objects of the present invention, which will become apparent from the description to follow, are accomplished by the improvements hereinafter described and claimed.

In general, a portable inflatable shelter for temporarily covering a portion of an object while partially resting on another portion of the object includes a plurality of inflatable interconnected tubes which carry fabric extending therebetween. When the tubes are inflated, the shelter formed thereby includes a roof section over the portion of the object, side sections on each side of the portion of the object, a front access opening, and an overhang section resting on the other portion of the object.

The portable inflatable shelter is erected by positioning the uninflated shelter adjacent to the portion of the object to be covered with the front access opening facing the ground. Guy lines are then attached from one of the side sections of the shelter to a first point on the ground. Additional guy lines are attached from the other side section to a second point on the ground. The shelter is then inflated and pivoted on an axis defined by the first and second points so that the shelter encloses the portion of the object to be covered.

BRIEF DESCRIPTION OF THE DRAWINGS

FIG. 3 somewhat schematically shows the shelter having been tied down and inflated, and showing the manner in which it is pivoted from the position on the ground adjacent the engine portion of the aircraft to a position enclosing the engine portion of the aircraft as shown in FIG. 1.

FIG. 4 is a somewhat schematic front view of the shelter after tensioning straps have been added to stabilize the front access opening.

FIG. 5 is a somewhat schematic rear view of the shelter after rear flaps have been closed around the back thereof.

PREFERRED EMBODIMENT FOR CARRYING OUT THE INVENTION

Figure 1:
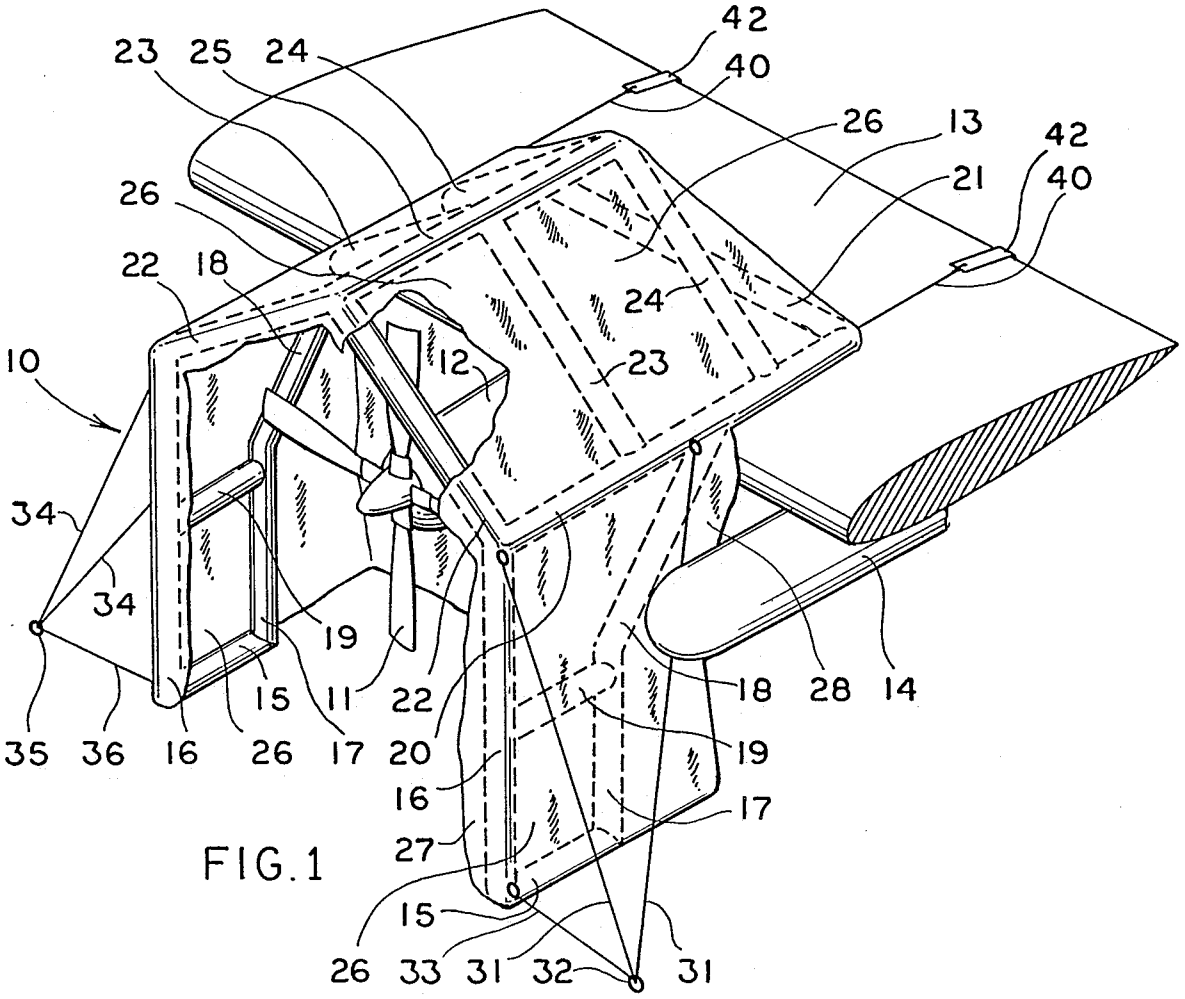
FIG. 1 is a somewhat schematic partially broken away and fragmented perspective view of the portable inflatable shelter shown as covering the engine portion of an aircraft.

An inflatable portable shelter according to the concept of the present invention is indicated generally by the numeral 10 and is shown as being used in conjunction with an airplane with portions thereof being generally schematically shown, such as, propeller 11, engine 12, wing 13 and fuel pod 14. It should be appreciated that shelter 10 can be used to protect or enclose other areas of an airplane, such as the dome over the cockpit, and can be used as well to enclose portions of any large object as may be necessary to effect outdoor repairs or the like.

Shelter 10 includes a plurality of inflatable interconnecting tubing formed so as to create a house-like configuration. Included are sill tubing 15 at the bottom of each side of shelter 10 which are interconnected at their front ends to vertical stud tubing 16 extending upwardly to define the front of shelter 10. The rear end of each sill tubing 15 is interconnected to a forked stud tubing 17 having a rearwardly inclined portion 18 which, as will hereinafter be more fully explained, is a design element of shelter 10 specifically needed when being used with an aircraft having a fuel pod 14 close to engine 12 so that the shelter 10 clears pod 14 upon erection. A generally horizontal brace tube 19 extends between and is interconnected to stud tubing 16 and forked stud tubing 17 on each side of shelter 10. Thus, each side of shelter 10 is defined by sill tubing 15, stud tubing 16, forked stud tubing 17 and horizontal brace tube 19.

The tops of stud tubing 16 and inclined portion 18 of forked stud tubing 17 on each side of structure 10 are interconnected to roof base tubing 20 which extend rearwardly and are interconnected by a laterally extending roof base tube 21 which, as will be discussed hereinafter in more detail, overhangs and rests on wing 13 when shelter 10 is fully erected. Front rafter tubes 22, medial rafter tubes 23 and rear rafter tubes 24 are interconnected to roof base tubing 20 and extend upwardly to be interconnected with ridge tubing 25.

The outside of all of the tubing just described carries and is otherwise attached to a weatherproof fabric 26 such as polyvinyl chloride coated polyester fabric. In addition, a front access closure drape 27 and rear closure drape 28, unsupported by any tubing, are provided to fully enclose shelter 10 once erected. Any one of the tubes may be provided with an inlet valve and dump valves (not shown) for easy inflation by a conventional air blowing source and easy deflation, as required. Details regarding the tubing, its connection to the fabric, the inflation thereof, and other aspects of inflatable shelters can be found in U.S. Pat. No. 4,631,873 to which reference is made for a more complete understanding of the present invention.

Figure 2:
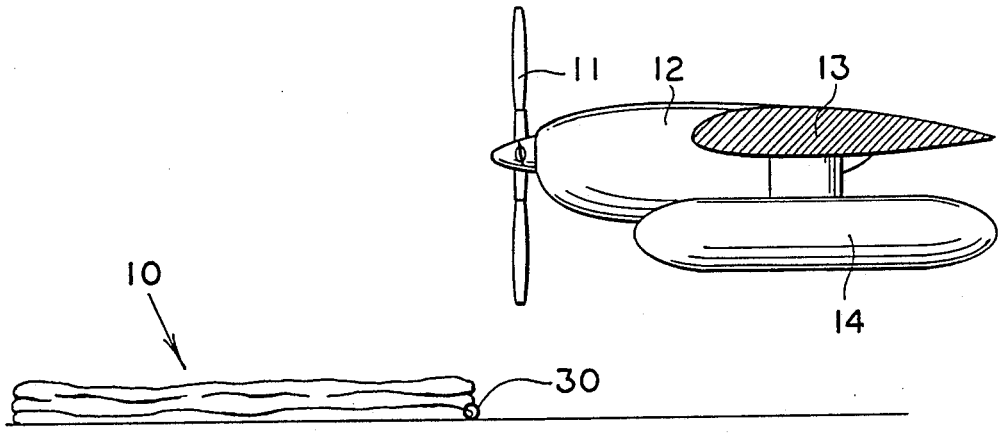
FIGS. 2–5, inclusive, somewhat schematically show the sequence of erection of the portable inflatable shelter, FIG. 2 showing the uninflated shelter positioned on the ground adjacent the engine portion of an aircraft.

The manner in which shelter 10 is erected will now be described in detail with specific reference to sequential FIGS. 2–5, inclusive. As shown in FIG. 2, shelter 10 is first located in a folded condition at a preselected position adjacent to the equipment to be worked on, in this instance the engine 12 of an aircraft. At this point the front access opening defined by the space between stud tubing 16 and rafter tubes 22 is in contact with the ground, that is, the front end of shelter 10 is face down. The exact location of this positioning will, of course, vary dependant on the size of the equipment being worked on and the attendant size of the shelter. As will become evident, the position selected is such that when the shelter is eventually swung into position about an axis identified by the numeral 30, to be more fully described hereinafter, the shelter will extend around and enclose the equipment being worked on. It should also be appreciated that the fact that shelter 10 can, in its uninflated position, be readily folded, as depicted in FIG. 2, renders it quite portable and, in fact, it can be readily carried in an aircraft and utilized for emergency maintenance purposes.

When shelter 10 is still in the position shown in FIG. 2, it is tied down prior to inflation. Such is accomplished by attaching a plurality of guy lines from the ground to each side of shelter 10 as shown most clearly in FIG. 1. As shown, guy lines 31 extend from an upper portion of one side of shelter 10 to a point 32 situated laterally outward from the lower front edge of stud tubing 16. A generally horizontal guy line 33 extends from that lower front edge to point 32. Similarly, guy lines 34 extend from an upper portion of the other side of shelter 10 to a point 35 situated laterally outward from the lower front edge of stud tubing 16 on the other side of shelter 10. A generally horizontal guy line 36 extends from that lower front edge to point 35. As will hereinafter become apparent, it is preferable at this time that guy lines 33 and 36 be taut but there can be some slack in guy lines 31 and 34. It is important that the points of guy line securement, that is, points 32 and 35, along with the front lower edges of stud tubing 16, are aligned and define axis 30 previously described.

Figure 3:
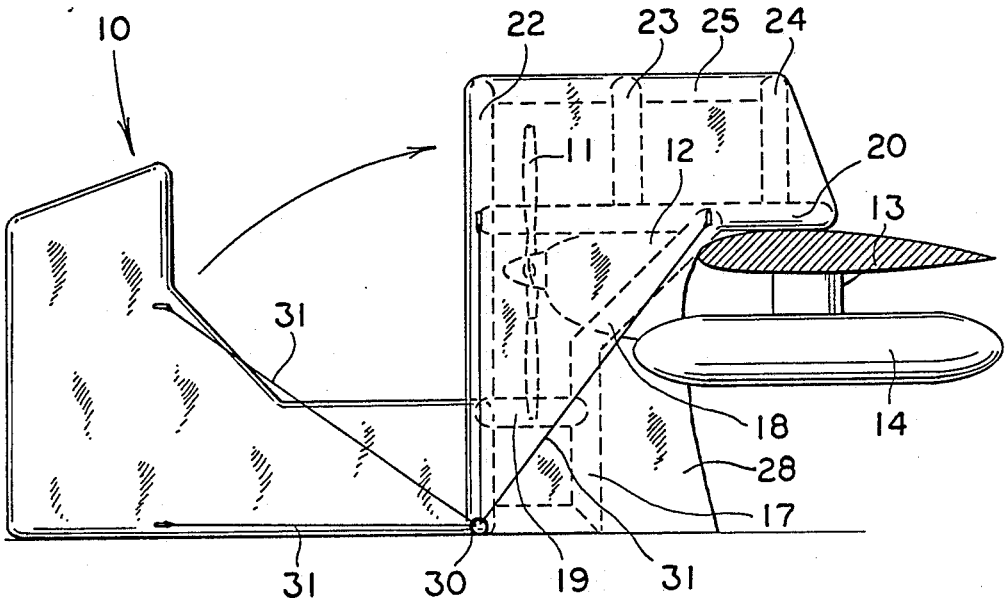
Figure 4:
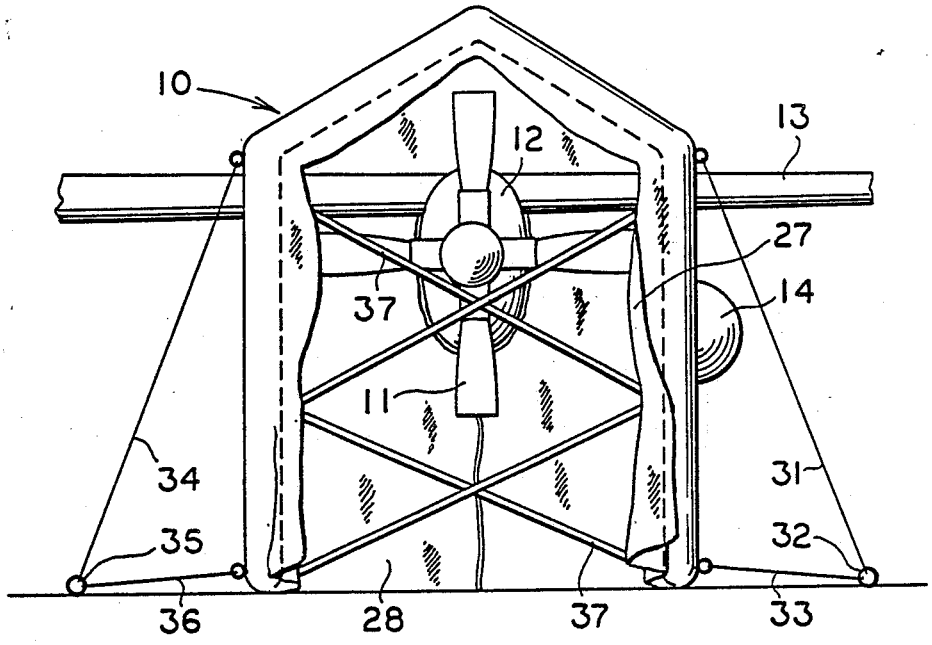
Figure 5:
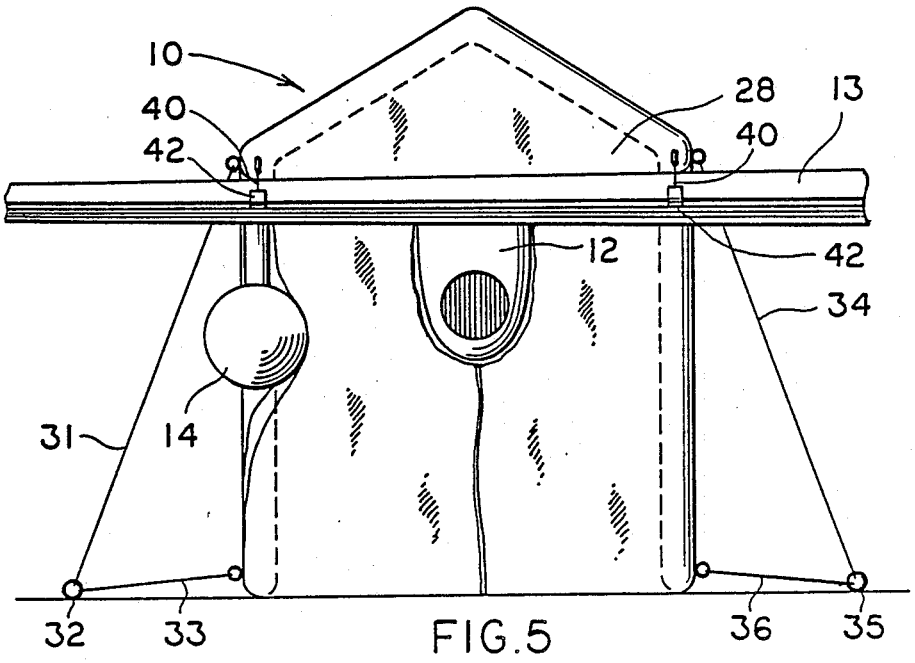

With shelter 10 so secured, all of the tubing is inflated and shelter 10 will take on its fully formed condition with the front access opening on the ground as shown on the left hand side of FIG. 3. Because shelter 10 has been tied down, it will stay stably positioned even in adverse wind conditions. Then shelter 10 is rotated 90° on axis 30 to its operating position over engine 12 as shown in FIG. 3. It should be noted that because of the incline of portion 18 of forked tubing 17, the fuel pod 14 is cleared with rear closure drape 28 being draped therearound. At that time guy lines 31 and 34 can be more fully tightened and additional guy lines as well as rear corner tie downs may be utilized, if desired, to fully locate shelter 10. Moreover, as shown in FIG. 4, tension straps 37 may be positioned between stud tubings 16 across the front access opening to stiffen the front of shelter 10 and if desired, to be fully protected from inclement weather conditions, front drape 27 can be closed with the ends thereof attached in a conventional manner such as by a velcro and strap attachment. Likewise, rear drapes 28 can be closed as shown in FIG. 5 and attached in a similar manner. As shown in FIG. 5, rear drapes can be configured so that the rear of engine 12 extends therethrough. It should also be noted from FIG. 5 that the shelter generally drapes around fuel pod 14 as previously described.

Figure 6:
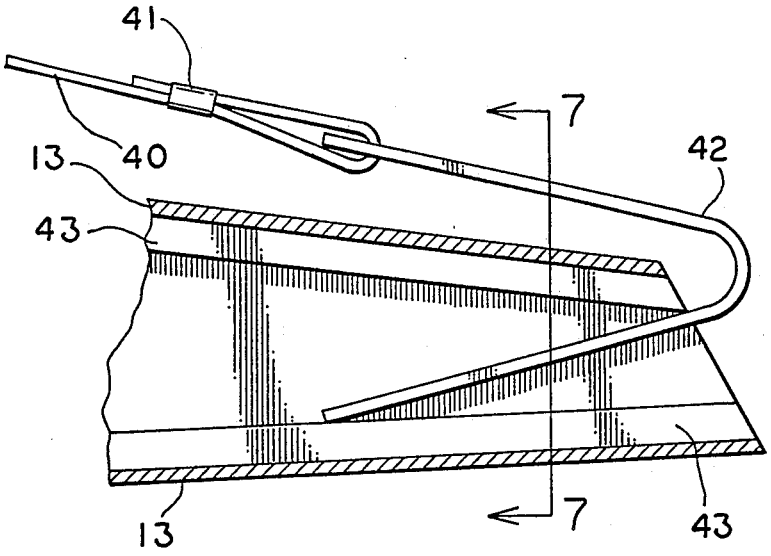
FIG. 6 is a fragmented somewhat schematic sectional view showing the manner in which the shelter is attached to the rear of the wing of the aircraft.
Figure 7:
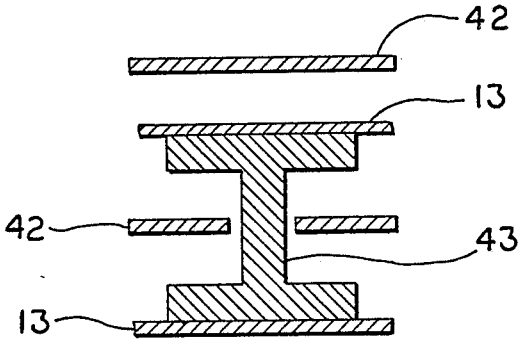
FIG. 7 is a sectional view taken substantially along line 7—7 of FIG. 6.

Finally, as previously described, when shelter 10 is in position to cover one portion of a piece of equipment, such as engine 12, the rear of the roof structure, and in particular laterally extending tube 21 and the rear portion of roof base tubing 20, rest on another portion of the equipment, in this instance wing 13. It is preferable that this overhang area be secured to the portion of the equipment upon which it is resting and in the instance of an aircraft wing, such a connection is best shown in FIGS. 1, 6 and 7.

As shown, a pair of tension straps 40 are attached at one end to shelter 10 at the area of longitudinally extending tube 21. The other end of each strap 40 is provided with a coupling clip 41 which carries a bifurcated bracket 42 which is generally boomerang shaped in profile. This configuration has been found to be convenient to hook onto the I-beam configured flap track 43 located internally within most aircraft wings. As best shown in FIG. 7, bifurcated bracket 42 is received within I-beam flap track 43 to securely hold shelter 10 on wing 13. Because of the shape of bracket 42, there is no metal to metal contact with the sensitive wing skin, the bracket merely contacting I-beam flap track 43 at the two locations shown in FIG. 6 which holds the bracket in place during loading. It should be appreciated that equivalent connecting devices, as would be evident to one skilled in the art, could be utilized with wings having differing configurations, with other portions of aircraft, if a portion other than the engine were being enclosed by shelter 10, or with portions of whatever piece of equipment was being sheltered, without departing from the spirit of this invention.

From the foregoing, it should be evident that a portable inflatable shelter constructed and erected as described herein will accomplish the objects of the invention and otherwise improve the art.

I claim:

1. A portable inflatable shelter for temporarily covering a first portion of an object while partially resting on a second portion of the object comprising a plurality of inflatable interconnected tubes, and a fabric carried by said tubes such that when said tubes are inflated said fabric and said tubes form a roof section over the first portion of the object, side sections on each side of the first portion of the object, a front access opening between said side sections and an overhang section extending from said roof section opposite said front access opening and resting on said second portion of the object.

2. A portable inflatable shelter according to claim 1 further comprising means to attach said overhang section to said second portion of the object.

3. A portable inflatable shelter according to claim 2 wherein the object is an aircraft with the first portion being an engine of the aircraft and the second portion being a wing of the aircraft, said means to attach including strap means extending from said overhang section and attached to the wing of the aircraft.

4. A portable inflatable shelter according to claim 3 wherein the wing includes an I-beam configured flap track and further comprising bracket means carried by said strap means for attachment to the flap track without damage to the wing.

5. A portable inflatable shelter according to claim 1 further comprising tension strap means extending between said side sections and across said front access opening to stabilize said front access opening.

6. A portable inflatable shelter according to claim 1 further comprising front access closure drape means carried by said side sections for selectively closing said front access opening.

7. A portable inflatable shelter according to claim 1 further comprising rear closure drape means carried by said side sections for selectively closing the rear of the structure.

8. A portable inflatable shelter according to claim 1 further comprising guy lines extending from each of said side sections to the ground.

9. A portable inflatable shelter according to claim 8 wherein said guy lines extending from one of said side sections extend to a first point on the ground laterally of said one of said side sections and said guy lines extending from the other of said side sections extend to a second point on the ground laterally of said other of said side sections.

10. A portable inflatable shelter according to claim 9 wherein said first and second points are aligned with said front access opening.

11. A portable inflatable shelter according to claim 1 wherein each said side section is formed of a plurality of stud tubes interconnected to sill tubes.

12. A portable inflatable shelter according to claim 11 wherein the object is an aircraft having a fuel pod, wherein one of said stud tubes of each said side section is formed for clearance around the fuel pod.

13. A portable inflatable shelter according to claim 11 wherein said roof section includes roof base tubes interconnected to said stud tubes, rafter tubes interconnected to said roof base tubes, and a ridge tube interconnected to said rafter tubes.

14. A portable inflatable shelter according to claim 11 wherein said overhang section extends rearwardly behind said stud tubes.

15. A portable inflatable shelter according to claim 14 wherein said roof section includes roof base tubes interconnected to said stud tubes, rafter tubes interconnected to said roof base tubes, and a ridge tube interconnected to said rafter tubes, a portion of said roof base tubes being included in said overhang section and resting on said second portion of the object.

16. A method of erecting a portable inflatable shelter over at least a portion of an object, the shelter having side sections with a front access entry therebetween, comprising the steps of positioning the uninflated shelter adjacent to the portion of the object with the front access entry adjacent to the ground, attaching guy lines from one side section of the shelter to a first point on the ground, attaching guy lines from the other side section of the shelter to a second point on the ground, inflating the shelter, and pivoting the shelter on an axis defined by said first and second points so that the shelter encloses the portion of the object.

17. A method according to claim 16 wherein the first and second points are located laterally of the side sections.

18. A method according to claim 17 wherein the first and second points are aligned with the front access opening.

19. A method according to claim 16 further comprising the step of resting a portion of the shelter on the object.

20. A method according to claim 19 further comprising the step of attaching the portion of the shelter to the object.

21. A method according to claim 16 further comprising the step of stabilizing the front access opening by attaching straps extending from one side section to the other across the front access opening.

22. A method according to claim 16 further comprising the step of closing the front access opening.

23. A method according to claim 16 further comprising the step of closing the rear of the shelter.

* * * * *